US005613902A

United States Patent [19]

Didion et al.

[11] Patent Number: 5,613,902

[45] Date of Patent: Mar. 25, 1997

[54] SAND RECLAIMER

[75] Inventors: Michael S. Didion; Charles J. Didion, both of St. Charles County, Mo.

[73] Assignee: Didion Manufacturing Company, St. Peters, Mo.

[21] Appl. No.: 621,090

[22] Filed: Mar. 25, 1996

[51] Int. Cl.[6] ..... B22D 29/00

[52] U.S. Cl. ..... 451/326; 451/328; 451/104; 451/113; 209/292; 241/79.3; 241/DIG. 10

[58] Field of Search ..... 451/104, 105, 451/113, 326, 328, 330; 209/292; 241/79.3, DIG. 10

[56] References Cited

U.S. PATENT DOCUMENTS

| | | | |
|---|---|---|---|
| 2,050,458 | 8/1936 | Ovestrud et al. . | |
| 3,862,719 | 1/1975 | Muller . | |
| 3,998,262 | 12/1976 | Didion . | |
| 4,050,635 | 9/1977 | Mueller et al. . | |
| 4,137,675 | 2/1979 | Cina et al. | 451/328 |
| 4,674,691 | 6/1987 | Didion . | |
| 4,981,581 | 1/1991 | Didion . | |
| 5,016,827 | 5/1991 | Didion . | |
| 5,095,968 | 3/1992 | Didion . | |
| 5,267,603 | 12/1993 | Didion . | |

FOREIGN PATENT DOCUMENTS

| | | |
|---|---|---|
| 0607650 | 7/1994 | European Pat. Off. . |
| 0129120 | 11/1978 | Japan . |
| 0084667 | 5/1983 | Japan . |

*Primary Examiner*—Willis Little
*Assistant Examiner*—Eileen P. Morgan
*Attorney, Agent, or Firm*—Paul M. Denk

[57] ABSTRACT

A tumbling mill includes an inlet area, an outlet area, and a tumbling area between the inlet and outlet areas. The mill is formed as a tri-cyclical member having an outer cylinder extending along the tumbling and outlet areas, and an inner cylinder concentric with the outer cylinder and extending through the inlet, outlet and tumbling areas. The inner and outer cylinders define a space therebetween. The inner cylinder is perforated to allow sand to fall into the space between the inner and outer cylinders. The inner cylinder includes an inner helical vane to urge sand, media, and castings toward the outlet area, and an outer helical vane to urge sand and media toward the inlet area. A reclassifying screen is provided in the inlet area to classify sand. Sand particles that are sufficiently small passes through the screen and out a chute. Sand particles that are not small enough are recirculated through the tumbling mill to be further broken down. A shell is positioned in the inlet area between the inner cylinder and the screen to hold the segments which form the inner cylinder together under heavy tumbling. The shell includes a plurality of relatively large openings to allow any sand that falls enters the shell to fall through to the screen. A third helical vane is positioned between the shell and the screen. Preferably, the edges of the third helical vane are aligned with the openings in the shell. The shell is sufficiently thick (preferably between ⅜" to 1") to prevent said segments from separating under pressure of extensive tumbling.

4 Claims, 2 Drawing Sheets

SAND RECLAIMER

BACKGROUND OF THE APPLICATION

This invention relates generally to a tumbling mill for new castings, and in particular to a tumbling mill with improved sand reclaiming abilities.

Various types of tumbling devices or mill for removing mold sand from casting, or for separating other particles or fragments from castings or other metal parts have long been available in the art. For example, my prior patent, U.S. Pat. No. 4,674,691, which is incorporated herein by reference, discloses a tumbler including a sand reclaimer which will return sand and media from the outlet area of the tumbler to the inlet area, where the media can be reintroduced into the tumbler. In my prior patent, U.S. Pat. No. 5,267,603, which is also incorporated herein by reference, I disclose another tumbler, which also includes a media and sand return system. This tumbler, however, is provided with a screen classifier which will allow small particles of sand to fall through a screen. The screen is provided at the inlet area of the tumbler and is housed in a casing. The sand which passes through the screen exits the tumbler through a chute in the housing. The screen surrounds the segmented inner liner and thus performs two functions: (1) it screens the sand so that small particles of sand will fall through and so that media and larger particles of sand will be reintroduced into the tumbler; and (2) it holds the segmented liner together in the intake area of the tumbler.

The segments are interlocked with each other, as described in my application Ser. No. 08/323,010, which is incorporated herein by reference. However, when a large number of heavy castings, such as engine block castings, are introduced into the tumbler, the tumbling of the castings within the unit may cause the segments to separate, either radially or horizontally. This can lead distorting of the screen. Eventually, the screen will have to be replaced, so that the intake section will be able to be held together.

SUMMARY OF THE INVENTION

One object of the present invention is to provide an improved sand reclaiming casting shake out unit or tumbler.

Another object is to provide finer sand screening whereby the openings in the final screen are now smaller than the openings in the liner segments.

Another object is to provide such a tumbler in which the inner liner of the tumbler is securely held together in a cylindrical fashion.

Another object is to enable the machine to breathe easier due to the increase in the screen open area.

Yet another object is to prevent blinding in the woven wire screen versus the larger punched slot in the main drum.

These and other objects will become apparent to those skilled in the art in light of the following disclosure and accompanying drawings.

In accordance with the invention, generally stated, a tumbling mill formed as a tri-cyclical type is provided. The tumbling mill includes an inlet area, an outlet area, and a tambling area between the inlet and outlet areas, an outer cylinder extending along the tumbling and outlet areas, and an inner cylinder concentric with the outer cylinder and extending through the inlet, outlet and tumbling areas. The inner and outer cylinders define a space therebetween. The inner cylinder is perforated to allow sand to fall into the space between the inner and outer cylinders. The inner cylinder includes an inner helical vane to urge sand, media, and castings toward the outlet area, and an outer helical vane to urge sand and media toward the inlet area. A reclassifying screen is provided in the inlet area to classify sand. Sand particles that are sufficiently small passes through the screen and out a chute. Sand particles that are not small enough are recirculated through the tumbling mill to be further broken down. A shell is positioned in the inlet area between the inner cylinder and the screen to hold the segments which form the inner cylinder together under heavy tumbling. The shell includes a plurality of relatively large openings to allow any sand that falls enters the shell to fall through to the screen. A third helical vane is positioned between the shell and the screen. Preferably, the edges of the third helical vane are aligned with the openings in the shell. The shell is sufficiently thick (preferably between ⅜" to 1") to prevent said segments from separating under pressure of extensive tumbling.

DESCRIPTION OF THE PREFERRED EMBODIMENT

Figure 1:
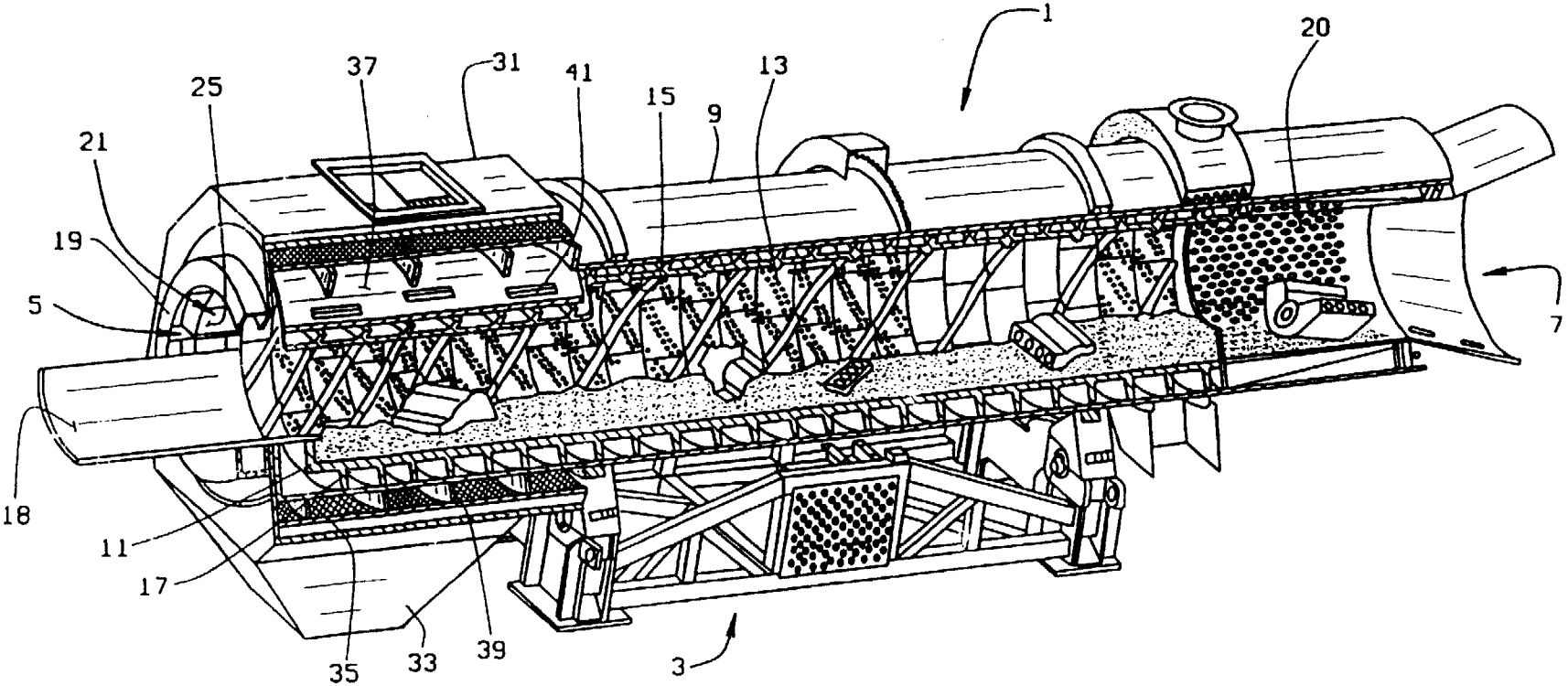
FIG. 1 is a perspective view, partially cut away, of a tumbling unit of the present invention.

A tumbler 1 of the present invention is mounted on a base 3. As described in my above noted patents, the base 3 includes a motor which rotationally drives the tumbler 1. The tumbler 1 includes an inlet 5 and an outlet 7, It comprises an outer cylinder 9 having an inner cylindrical liner 11 supported concentrically within the outer cylinder 9. The liner 11 has perforations 13 and is formed of segmented modular components that are sectionalized and fitted together to form the liner 11. A helical vane 15 is formed on the inner surface of the liner 11 and a second helical vane 17 is formed on the outer surface of the liner 11.

Preferably, a chute or conveyor 18 is provided at the inlet 5 of the tumbler to deliver castings, media, and sand into the tumbler. As discussed in my prior patents, the inner vane or rifling 15 tends to urge the castings, media, and sand toward the outlet 7 of the tumbler 1. Along the way, the sand falls through the perforations 13 in the liner 11 of the tumbler. At the outlet 7 of the tumbler 1, the remaining sand and media falls through larger perforations 20, and the castings exit the tumbler. The outer vanes 17 of the liner 11 operate to urge the sand and media back toward the inlet 5 of the tumbler.

The tumbler inlet 5 is provided with an intake paddle wheel or lifts 19 and a recirculation wheel 21. The recirculation wheel 21 is secured to the liner 11 and the intake wheel 19 is secured to the recirculation wheel. Thus, the intake wheel 19 and the recirculation wheel 21 rotate with the inner liner 11. The recirculation wheel 21 includes an outer or front wall 23 which stops the reverse flow of the sand and media. A series of paddles or lifts 25 in the recirculation wheel 21 carries the media and sand up, and when the vane is tilted, due to rotation of the wheel, the sand and media fall off the recirculation wheel paddles and onto the chute to be reintroduced into the tumbler 1.

The inlet area of the tumbler is provided with a dust collection hood 31 having a sand chute 33. A perforated screen 35 surrounds the liner 11 in the inlet area. The screen perforations are sized to allow a desired size of sand particle through the screen. The classified sand falls through the screen and down the chute for collection. The larger sand particles and the media are then reintroduced into the tumbler. This allows for the recirculation of the media, and further reduction of the size of the sand particles.

In prior sand reclaiming tumblers, such as shown in my above noted patent, U.S. Pat. No. 5,267,603, the liner 11 in the inlet area is substantially unsupported. There is thus nothing to support or reinforce the inlet where the liner segments separate the sand from the media. In the remaining sections of the tumbler, the outer vanes 17 extend substantially the distance between the outer cylinder 9 and the liner 11. Thus, the outer cylinder 9 supports the liner throughout the remaining sections of the tumbler. In the prior tumbler, the screen 35 directly surrounded the liner 11. However, under certain circumstances, the screen 35 may not be sufficient to support the liner, and the liner 11 may begin to separate. The tumbler of the present invention is thus provided with a shell 37 in the inlet area. The shell 37 directly surrounds the liner 11 to hold the liner 11 in its cylindrical configuration. The shell 37 is much sturdier than the screen 35, and is preferably made of ⅜" to 1" plating, whereas the screen is much thinner. The screen 35 is spaced from the outer surface of the shell 37 by a third helical vane 39. Unlike helical vanes 15 and 17, which extend substantially the length of the tumbler, helical vanes 39 extend only the length of the inlet area.

Figure 3:
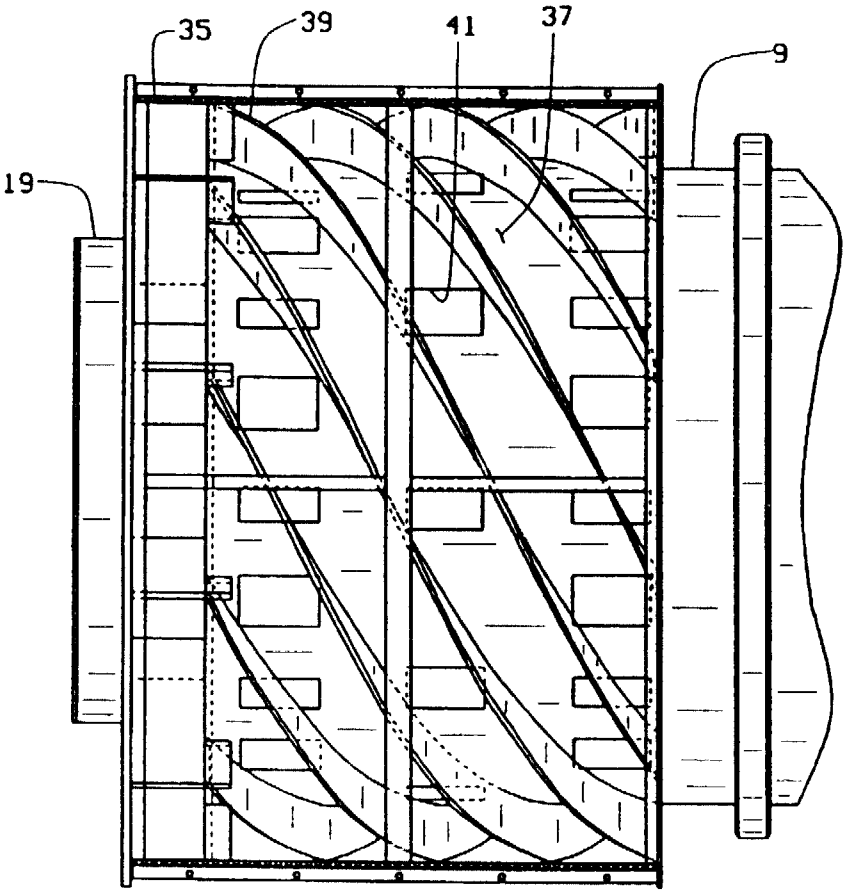
FIG. 3 is a side elevational view of an inlet area of the tumbler, partly in cross-section, with the outer cylinder of the tumbler removed.
Figure 2:
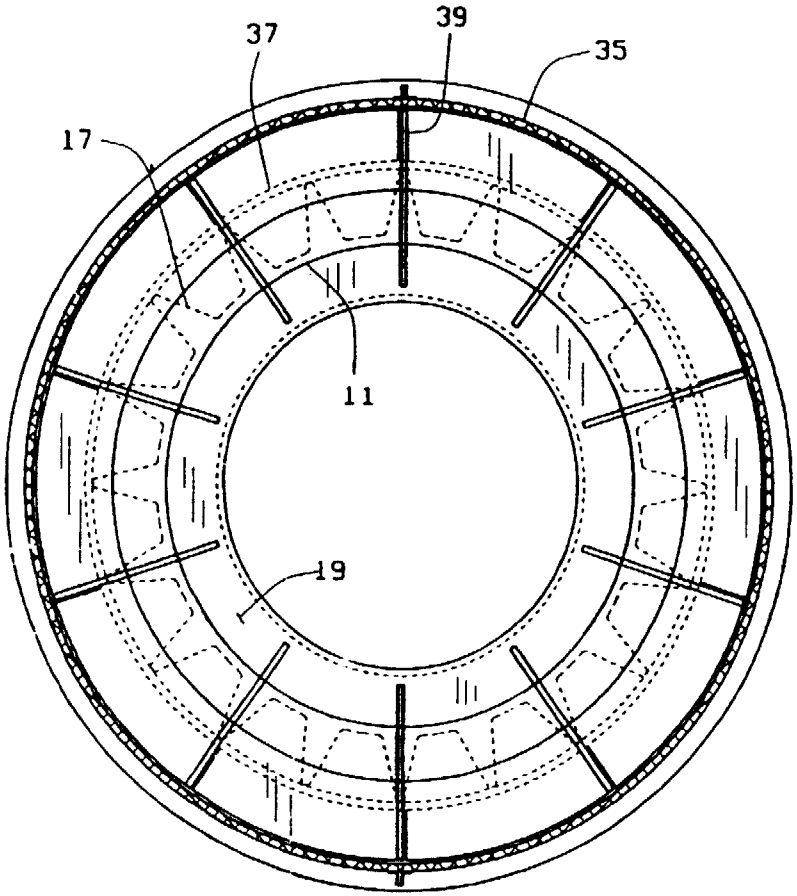
FIG. 2 is a cross-sectional view unit taken through an inlet area of the unit.

The shell 37 has a diameter substantially equal to the outer cylinder 9. Thus, the media and sand which fall through the liner 11 will end up on the inner surface of the shell 37. To allow the sand and media to be classified by the screen 35, the shell 37 is provided with a plurality of openings 41. The openings can be any desired size and shape. Preferably, they are rectangular and have are about 4"×9" in size. As can be seen in FIG. 3, the openings 41 and vanes 39 are positioned such that the edge of the vanes 39 line up with the edge of the openings 41. Preferably, the edges of the vanes 17 also line up with the edge of the openings 4 1. This will ensure that a majority of the sand will fall through the shell 37 to be classified by the screen 35.

As variations within the scope of the appended claims may be apparent to those skilled in the art, the foregoing description is set forth only for illustrative purposes and is not meant to be limiting.

I claim:

1. A tumbler for use in separating surface disposed core sand from fresh or dirty castings by tumbling said castings in the presence of abrasive members, said rambler comprising:

an inlet area, an outlet area, and a tumbling area between said inlet and outlet areas;

an outer cylinder extending along said tumbling and outlet areas;

an inner cylinder concentric with said outer cylinder and extending through said inlet, outlet and tumbling areas, said inner cylinder and outer cylinder defining a space therebetween, said inner cylinder being perforated to allow sand to fall into said space between said inner and outer cylinder; said inner cylinder including an inner helical vane to urge sand, media, and castings toward said outlet area, and an outer helical vane to urge sand and media toward said inlet area;

a shell in said inlet area, said shell having an inner diameter approximately equal to the diameter of said outer helical vane, said shell defining a plurality of openings therein through which sand and media may fall; and a perforated screen surrounding said shell, said screen perforations being sized to allow sand particles of a desired size to fall therethrough, said screen being supported about said shell by a third helical vane.

2. The tumbler of claim 1 wherein edges of said third helical vane are aligned with said openings in said shell.

3. The tumbler of claim 2 wherein said inner cylinder comprises a plurality of interconnected segments; said shell being sufficiently thick to prevent said segments from separating under pressure of extensive tumbling.

4. The tumbler of claim 3 wherein said shell is made of ⅜" to 1" sheeting.

* * * * *

UNITED STATES PATENT AND TRADEMARK OFFICE

CERTIFICATE OF CORRECTION

PATENT NO. : 5,613,902

DATED : March 25, 1997

INVENTOR(S) : Michael S. Didion, et al.

It is certified that error appears in the above-indentified patent and that said Letters Patent is hereby corrected as shown below:

Column 4, Claim 1, line 9, change "rambler" to ---tumbler---.

Signed and Sealed this

Eighth Day of July, 1997

Bruce Lehman

*Attest:*

BRUCE LEHMAN

*Attesting Officer*

*Commissioner of Patents and Trademarks*